US007341261B2

(12) United States Patent
Shing

(10) Patent No.: US 7,341,261 B2
(45) Date of Patent: Mar. 11, 2008

(54) SKATE

(76) Inventor: Chu Yau Shing, Room 303, Po Lun House, Siu Lun Court, Tuen Mun, N.T. (HK)

( * ) Notice: Subject to any disclaimer, the term of this patent is extended or adjusted under 35 U.S.C. 154(b) by 70 days.

(21) Appl. No.: 11/245,584

(22) Filed: Oct. 7, 2005

(65) Prior Publication Data

US 2007/0029742 A1 Feb. 8, 2007

(30) Foreign Application Priority Data

Aug. 4, 2005 (HK) ..... 05106714

(51) Int. Cl.
*A63C 1/00* (2006.01)

(52) U.S. Cl. ..... 280/11.27; 280/11.19; 280/11.231

(58) Field of Classification Search ..... 280/11.27, 280/11.28, 11.233, 11.25, 11.223, 11.221, 280/11.24, 7.14, 11.231, 11.19
See application file for complete search history.

(56) References Cited

U.S. PATENT DOCUMENTS

| | | | | | |
|---|---|---|---|---|---|
| 480,610 | A | * | 8/1892 | Nielson | 280/11.221 |
| 824,108 | A | * | 6/1906 | Fulton | 280/11.25 |
| 864,622 | A | * | 8/1907 | Domis | 280/11.25 |
| 1,332,702 | A | * | 3/1920 | Wisniewski | 280/11.27 |
| 1,600,075 | A | * | 9/1926 | Stoops | 280/11.24 |
| 1,868,548 | A | * | 7/1932 | Turner | 280/11.232 |
| 3,224,785 | A | * | 12/1965 | Stevenson | 280/11.25 |
| 3,374,002 | A | * | 3/1968 | Lewis | 280/11.24 |
| 3,476,399 | A | * | 11/1969 | Finn | 280/11.25 |
| 4,988,122 | A | | 1/1991 | Saunders | 280/841 |
| 5,135,244 | A | * | 8/1992 | Allison | 280/11.28 |
| 5,320,366 | A | | 6/1994 | Shing | 280/7.14 |
| 5,673,941 | A | * | 10/1997 | Osawa | 280/11.28 |
| 6,015,157 | A | * | 1/2000 | Hilgarth | 280/11.27 |
| 6,425,587 | B1 | * | 7/2002 | Moon | 280/11.221 |
| 6,959,933 | B1 | * | 11/2005 | Roth | 280/11.25 |
| 7,059,613 | B2 | * | 6/2006 | Farrelly et al. | 280/11.27 |

FOREIGN PATENT DOCUMENTS

| | | | |
|---|---|---|---|
| CN | 87213676 | U | 9/1988 |
| CN | 2103352 | U | 5/1992 |
| CN | 2111781 | U | 8/1992 |
| CN | 2161344 | Y | 4/1994 |
| CN | 2460164 | Y | 11/2001 |
| CN | 2480022 | Y | 3/2002 |
| CN | 2520912 | Y | 11/2002 |
| CN | 2593852 | Y | 12/2003 |
| CN | 1485111 | A | 3/2004 |
| CN | 2605899 | Y | 3/2004 |
| DE | 4300053 | | 7/1994 |

* cited by examiner

*Primary Examiner*—Hau Phan
(74) *Attorney, Agent, or Firm*—J.C. Patents

(57) ABSTRACT

A skate includes a shoe body and a skating device, wherein the sole of the shoe body comprises a front part, a middle bow part and a rear part. The skating device is mounted only under the middle bow part. Therefore, the toe of the front part and the heel of the rear part can respectively contact with the ground easily. When the toe of the front part contacts with the ground, the angle A between the plane of the sole and the ground is less than 45°. When the heel of the rear part contacts with the ground, the angle B between the plane of the sole and the ground is less than 45°.

9 Claims, 9 Drawing Sheets

SKATE

CROSS-REFERENCE TO RELATED APPLICATION

This application claims priority benefit of Hong Kong Short-Term Patent No. HK05106714.7 filed on Aug. 4, 2005, the content of which is hereby incorporated by reference in its entirety.

TECHNICAL FIELD

The present invention relates to a skate, and in particular to a skate which is easy to control so as to provide the wearer with increased safety.

BACKGROUND ART

Skating is a very popular sport, but it takes long time to possess the skills of skating through a process of learning, practicing and often falling. In order to minimize the possibility of being hurt during the sport, the beginners always wear various protective garments, which reduce the fun in the sport.

The conventional skates include roller skate for landing skating, Gustily Walking Shoes and ice skate used on real ice. The roller skate must have a braking device at the toe or the heel of the shoe in order to provide a more stable manner for the wearer because it is hard for the toe or the heel to contact the ground during the movement. But due to the little area of the braking device contacting the ground, the capability of the wearer in keeping balance is restricted. Furthermore, the braking device is usually mounted at the toe, which can not help to prevent falling in the case that the wearer loses balance backwards.

There are two kinds of Gustily Walking Shoes. One comprises a single wheel at the heel of the shoe. Since the wheel is located at the heel part and there is a small distance between the sole and the ground, it is easy for the toe of the shoe to contact the ground. The problem is that the easy contact will be obstructive to the smooth sliding. Since the center of gravity for the human body is at the arch instead of the heel during skating, the wearer must raise his toes forcibly with an unnatural posture when using said shoes. Furthermore, the design of a single wheel makes it difficult to keep balance in the front-and-rear direction during skating. Another comprises two rows of wheels at the toe and the heel, which will help the body to keep balance. However, the problem is the distance between the front wheel and the rear wheel is too big. The wheels are very close to the toes and the heels of the shoes instead of at the arches of the shoes. When the wearer tries to make body stable by contacting the toes and heels with the ground, the result is not good enough because of the little contact area. In addition, since the Gustily Walking Shoes are designed to have the function of walking, the diameter of the wheel shall be restricted, and so the feeling of sliding can not compare with that of wearing the roller skate with single function.

The ice skate used on real ice usually comprises a single blade, and the wearer is hard to keep balance during skating. The blade is comparatively long, whereby the toe and the heel can not contact with the ground and the wearer can not make the body stable when he is about to fall. The friction between the blade and the ice surface is also small. It is even more difficult for the beginner to control the body and keep balance.

Although there are various skates on the market at present and the patent documents also disclose various new type skating devices, for example, Chinese utility models CN87213676U, CN2103351U, CN2111781U, CN2161344Y, CN1485111A, CN2593852Y, CN2460164Y, CN2480022Y, CN2605899Y, CN2520912Y, US patent U.S. Pat. No. 6,629,698B2, U.S. Pat. No. 6,536,785B2, U.S. Pat. No. 6,698,769B2, U.S. Pat. No. 6,450,509B2, U.S. Pat. No. 5,320,366, U.S. Pat. No. 4,988,122, and German patent DE4300053A1. However, none of the prior arts provide successfully a skate which is easy to control, ensures safety and has simple structure.

SUMMARY OF THE INVENTION

In view of the problems existing in the prior art, the object of the present invention is to provide a skate with which the wearer is easy to keep the balance of body by contacting the toe or heel of the shoe with the ground.

In order to achieve the above said object, the skate of the present invention includes a shoe body and a skating device, wherein the sole of the shoe body comprises a front part, a middle bow part and a rear part. The skating device is mounted only under the middle bow part such that the toe of the front part and the heel of the rear part can respectively contact with the ground. When the toe of the front part contacts with the ground, the angle between the plane of the sole and the ground is less than 45°. When the heel of the rear part contacts with the ground, the angle between the plane of the sole and the ground is less than 45°.

The person who wears the skate of the present invention can easily stop himself by contacting the toe or the heel with the ground so as to prevent the body from losing balance and tumbling. In that case, the beginner will possess the skills of skating easily and soon.

BRIEF DESCRIPTION OF THE DRAWINGS

The present invention is described with reference to the following drawings, wherein.

PREFERRED EMBODIMENTS

Figure 1:
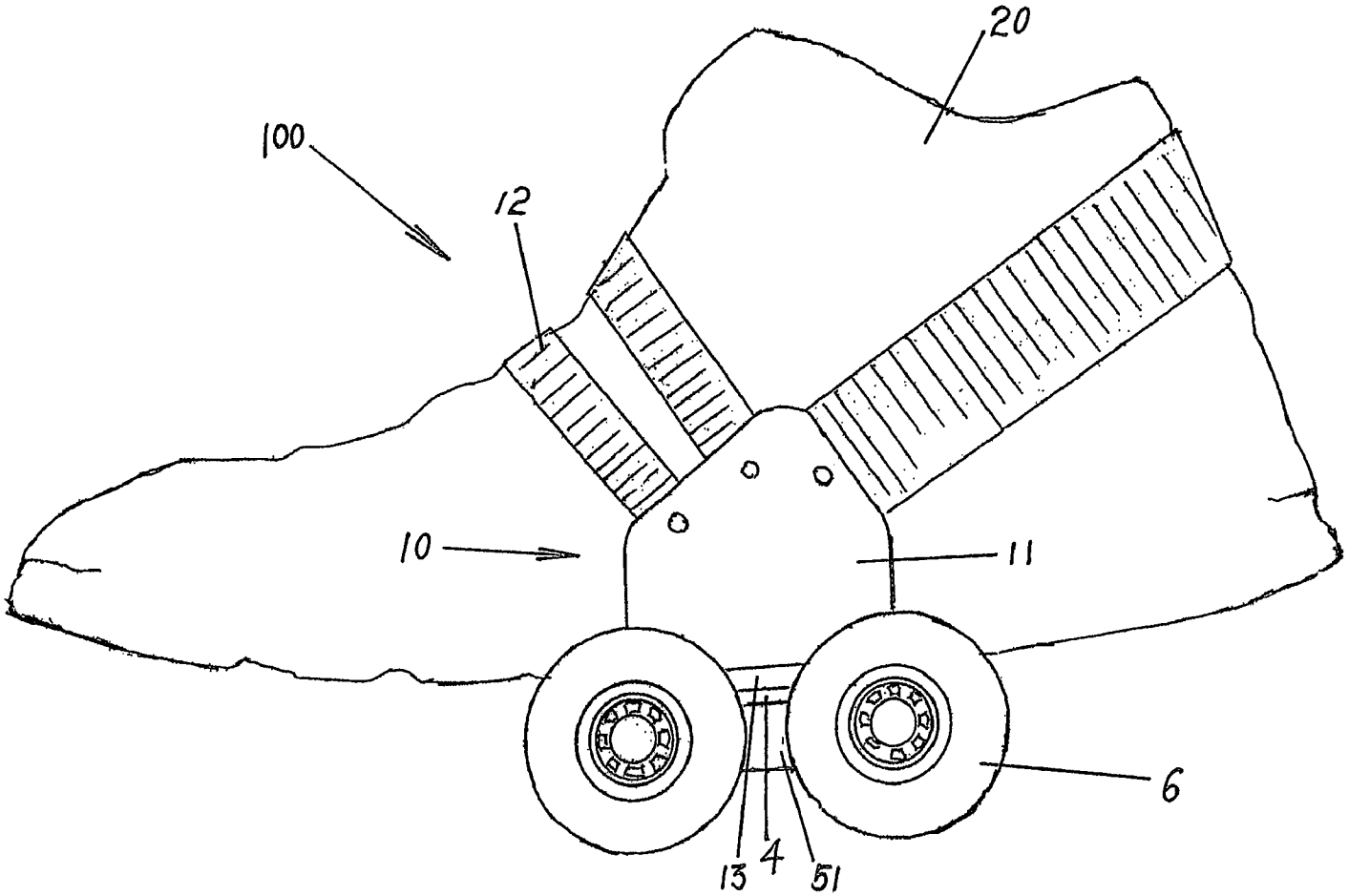
FIG. 1 is a schematic view of one embodiment of the skate of the present invention.
Figure 2:
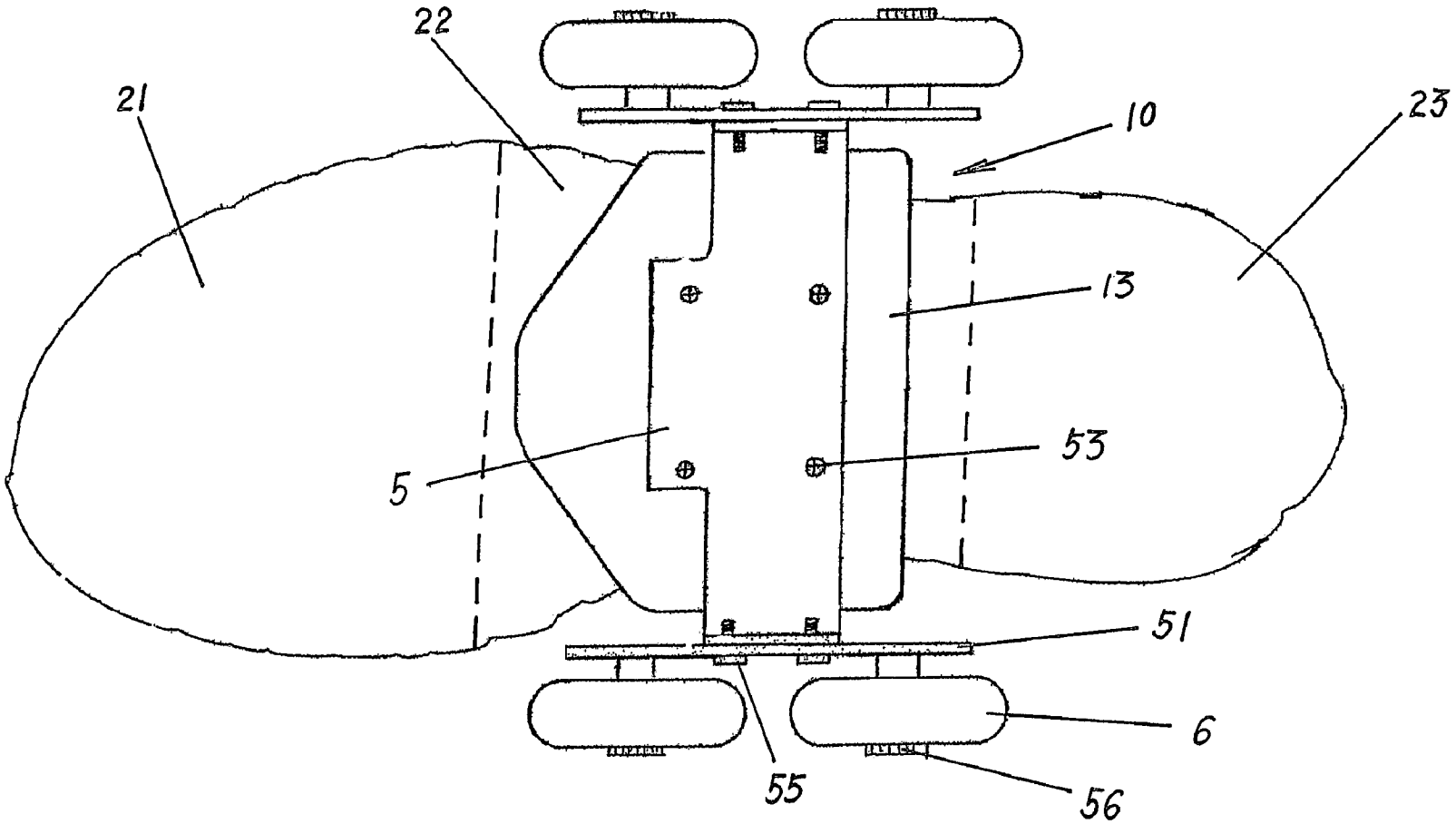
FIG. 2 is a bottom view of the FIG. 1.
Figure 3:
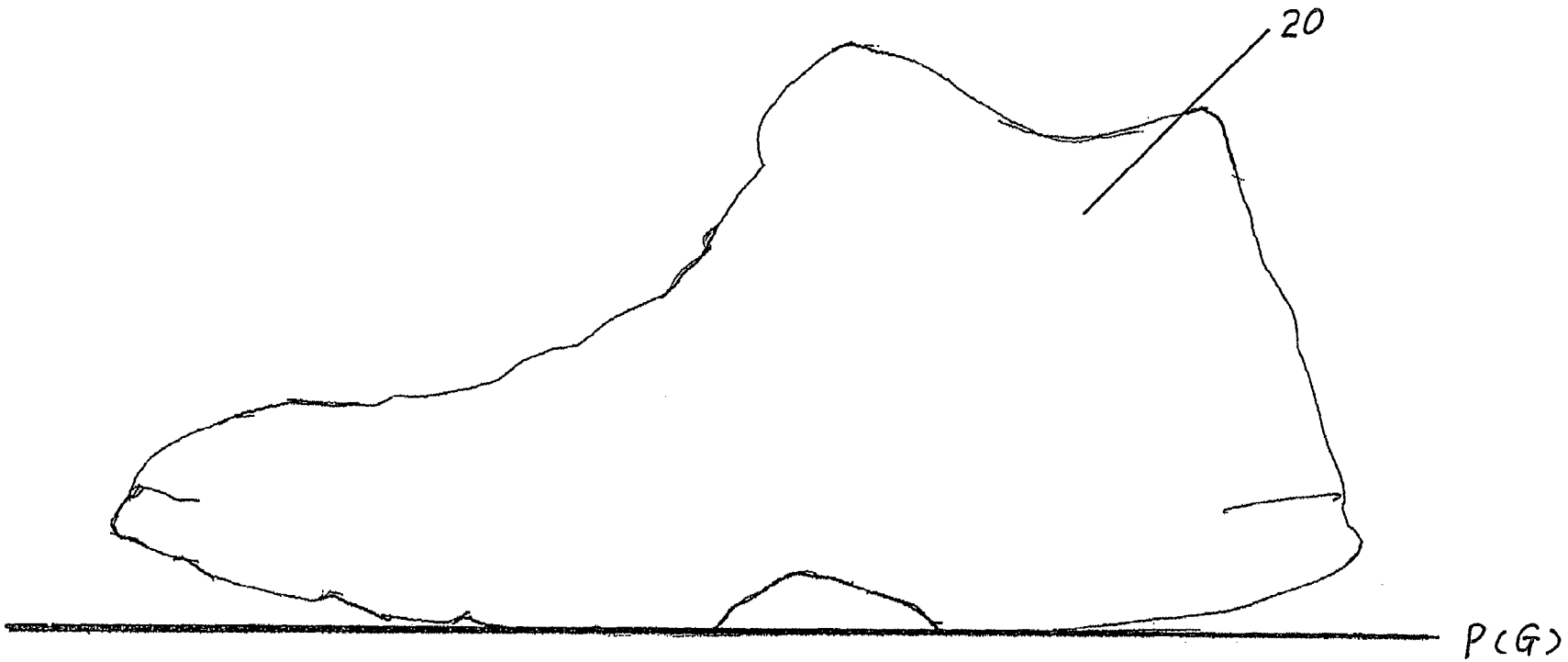
FIG. 3 is a schematic view of the sole plane of the skate of the present invention.
Figure 4:
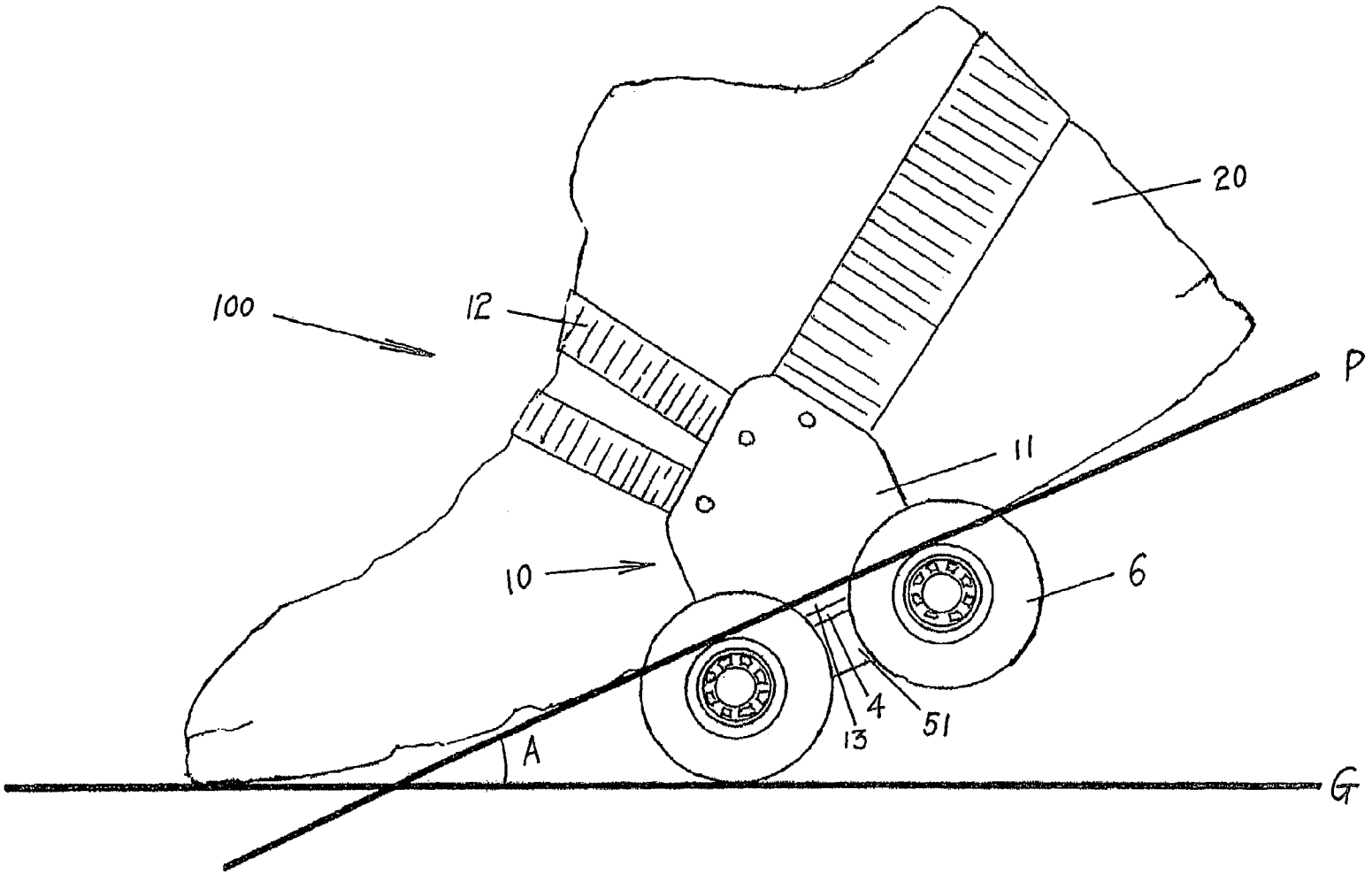
FIGS. 4-5 are each a schematic view of the angle between the plane of the sole and the ground when the toe and the heel contacting with the ground respectively.
Figure 5:
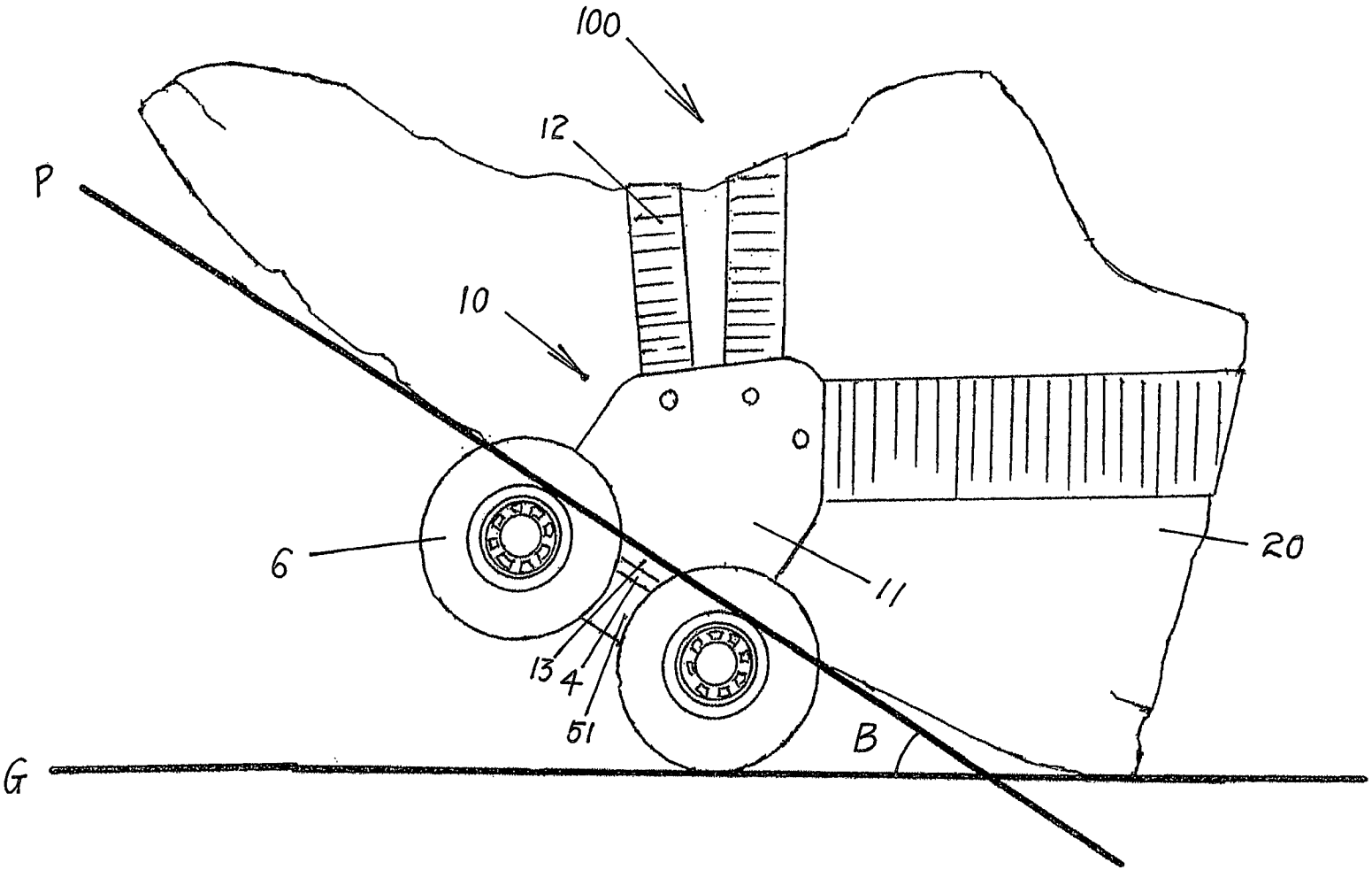

As shown in the FIGS. 1-9, the skate 100 of the present invention includes a shoe body 20 and a skating device 10. As shown in FIG. 2, corresponding to the shape of the feet, the sole of the shoe body 20 comprises a front part 21, a middle bow part 22 and a rear part 23. The skating device is mounted under the middle bow part 22. Each part of the sole is soft. The size and the mounting position of the skating device 10 are designed such that the front part or the rear part of the shoe can contact the ground at any time during the skating, thereby keeping the balance of the body and preventing from tumbling. As shown in FIG. 3, the sole plane P is a hypothetical plane of the outmost profile of the sole, which plane coincides with the ground G when the sole is on the ground flatwise without bearing any external force. As shown in FIG. 4, when the toe of the front part 21 contacts with the ground and supposing the sole is not distorted, the contact angle A between the sole plane P and the ground G is less than 45°, preferably between 10-35°. Similarly, as shown in FIG. 5, when the heel of the rear part 23 contacts with the ground G and supposing the sole is not distorted, the contact angle B between the sole plane P and the ground G is also less than 45°, preferably between 10-35°. Since the sole is soft, once the toe or the heel contacts with the ground G, the point contact will be quickly changed into surface contact so as to increase the friction between the sole and the ground, whereby the sliding body will stop instead of tumbling.

Figure 6:
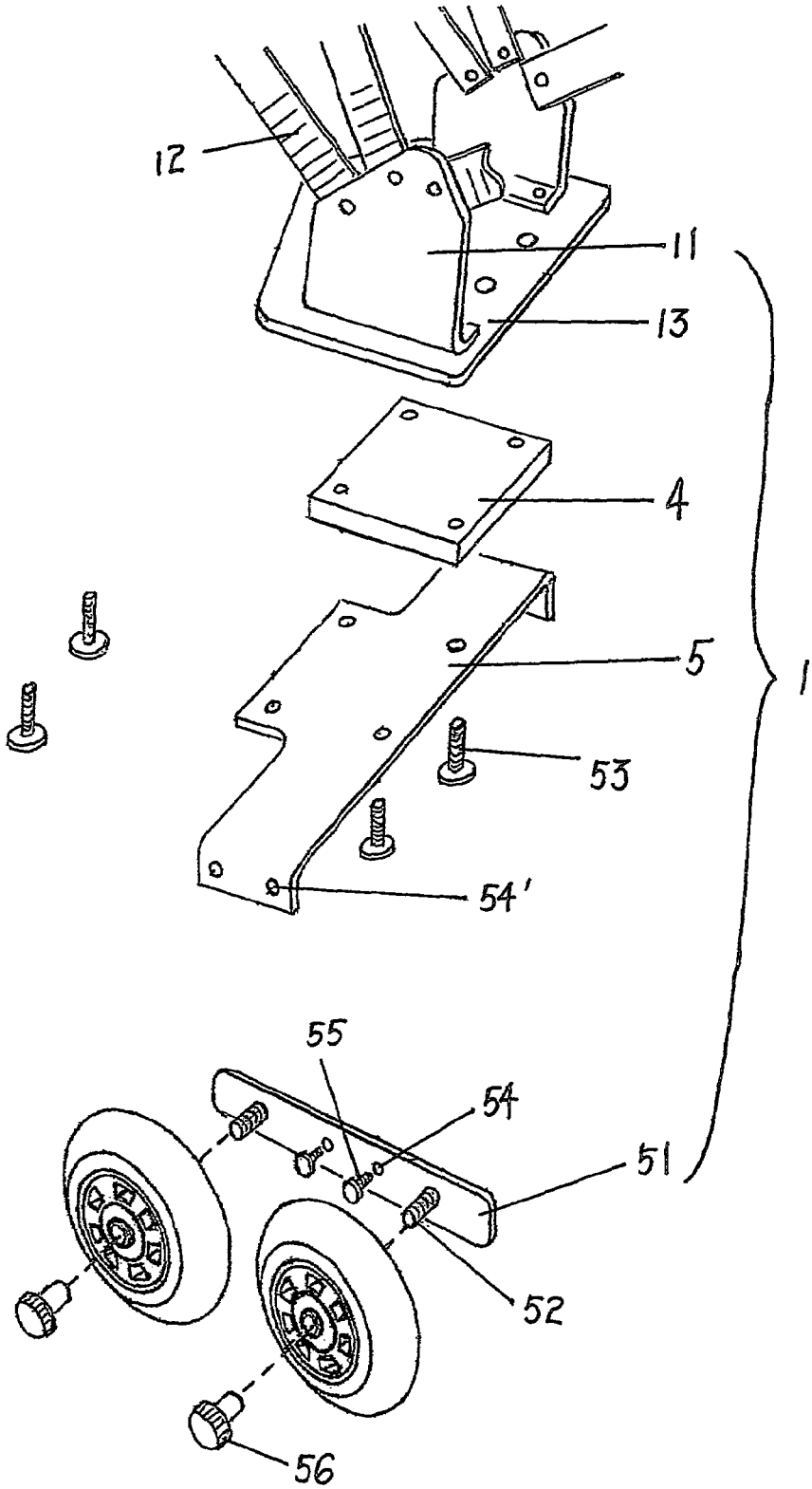
FIG. 6 is an exploded perspective view illustrating the skating device of the skate in FIG. 1.
Figure 7:
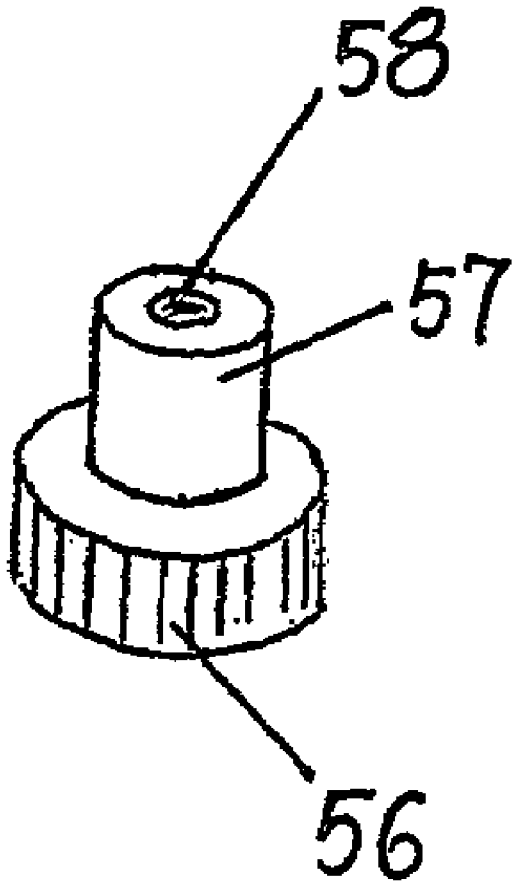
FIG. 7 is a schematic view of the cap in the FIG. 6.

As shown in FIG. 6, the skating device comprises a mounting bracket 1, wheels 6 and an axle. The mounting bracket 1 is used to secure the whole skating device to the middle bow part 22 of the shoe body 20. In the present embodiment, the mounting bracket 1 is tied to the shoe body 20 through a band 12 so as to form a detachable structure. The mounting bracket 1 also comprises a footplate 13, side plates 11 on two sides of the footplate for securing the band 12, a wheel-rack 5 connected with the footplate 13, and an auxiliary support 51 mounted on two sides of the wheel-rack 5 for securing the axle bolt 52. One end of the band 12 may be connected to the side plates 11 through a rivet, thus being able to rotate at discretion to adjust the direction of tying. The wheel-rack 5 is connected to the footplate 13 through a bolt 53. The auxiliary support 51 is provided with a conjoining hole 54 corresponding to a conjoining hole 54' at the side face of the wheel-rack 5, through which conjoining holes a bolt 55 connects the auxiliary support 51 with the wheel-rack 53. The wheel 6 is mounted on the axle bolt 52, with a cap 56 covering thereon. As shown in FIG. 7, the cap 56 comprises an axle portion 57 and a cap portion having larger diameter than the axle portion. The axle portion 57 of the cap 56 is formed with a threaded hole 58 engaging with the axle bolt 52 so as to form the axle of the wheel 6, while the cap portion of the cap 56 stops the wheel 6 so as to keep it on the axle. A vibration absorbing element 4 may be provided between the wheel-rack 5 and the footplate 13 in order to damp the vibration generated during skating. The vibration absorbing element 4 may be made of any elastic material.

Corresponding to the values of the angles A and B as mentioned before, the ratio of the shortest distance between the axle center of the skating device and the foremost end of the sole to the distance between the sole and the ground is more than 1.5:1, preferably 1.7:1 to 10:1; the ratio of the shortest distance between the axle center of the skating device and the aftermost end of the sole to the distance between the sole and the ground is more than 1.5:1, preferably 1.7:1 to 10:1.

In a preferable case, the shortest distance between the axle center of the skating device and the vertical surface where the foremost end of the sole is located is more than 30% of the length of the sole; the shortest distance between the axle center of the skating device and the vertical surface where the aftermost end of the sole is located is more than 25% of the length of the sole. In the embodiment shown in FIGS. 1-4, the skating device comprises two rows of wheels, and the aforementioned distances are respectively the distance between the front wheel and the front end of the shoe and the distance between the rear wheel and the rear end of the shoe. The distance between the sole and the ground can be adjusted by selecting wheels having different diameters or by changing the position of the conjoining hole on the auxiliary support 51.

Figure 8:
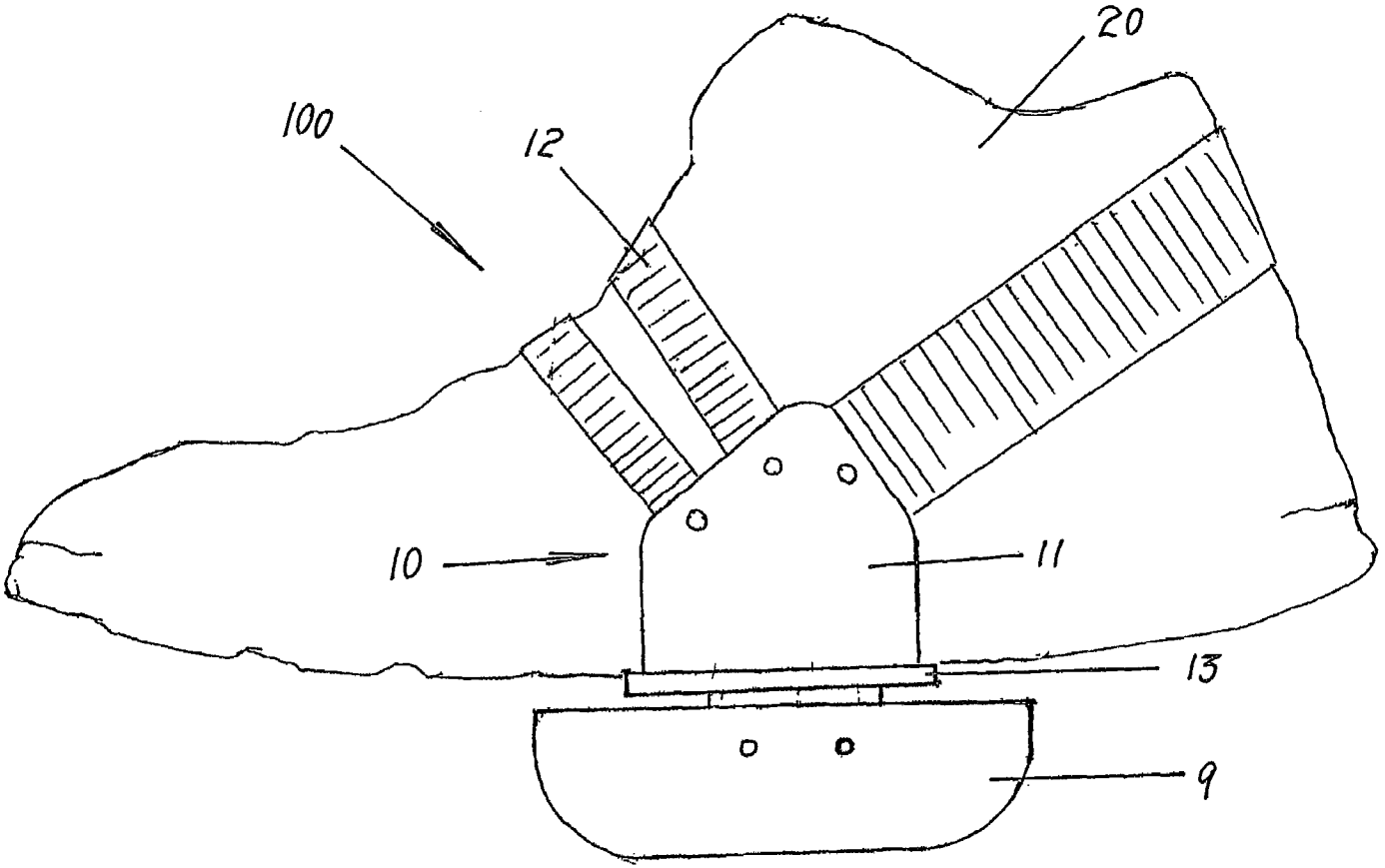
FIG. 8 is a schematic view of another embodiment of the skate of the present invention.
Figure 9:
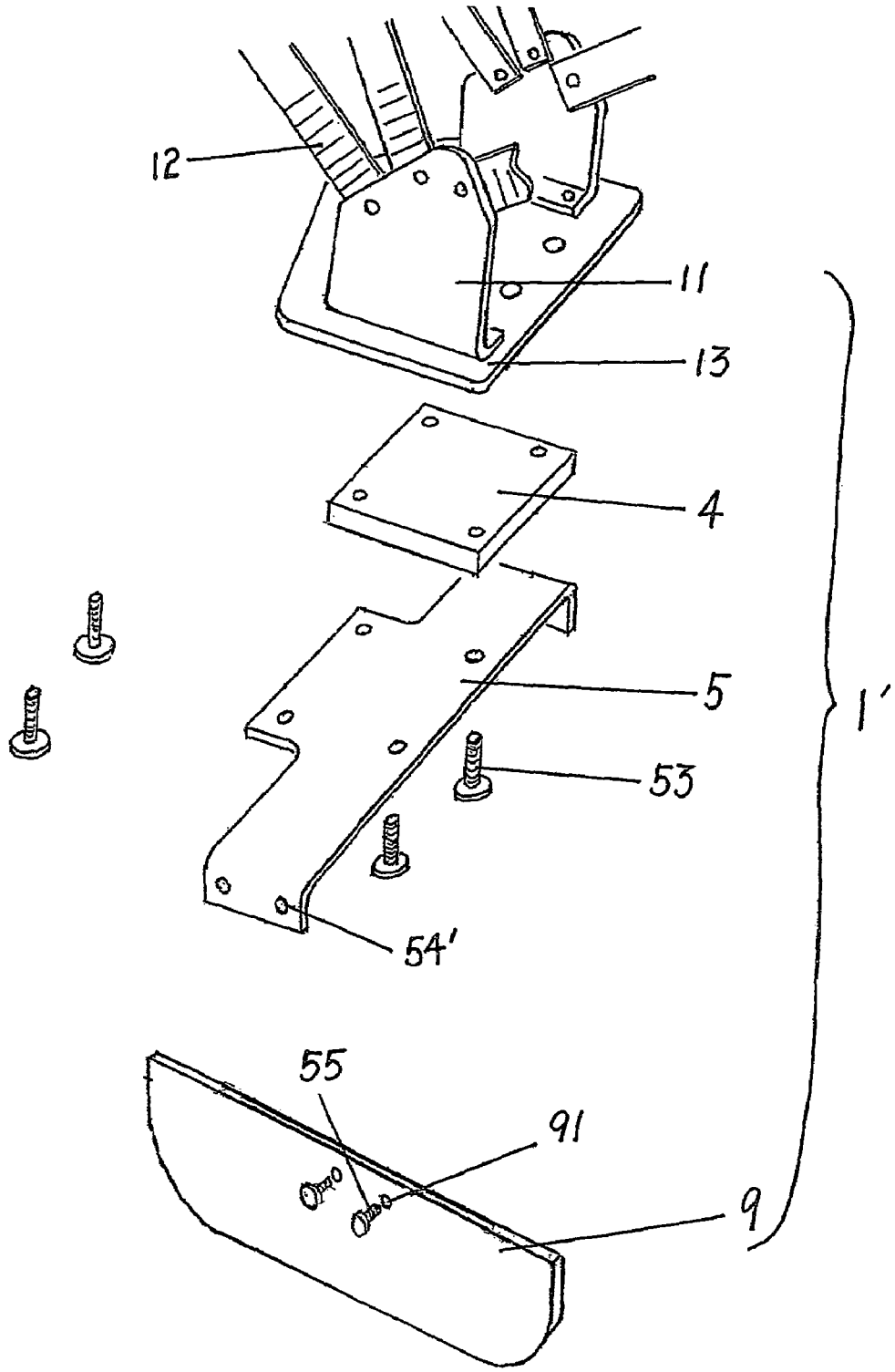
FIG. 9 is an exploded perspective view illustrating the skating device of the skate in FIG. 8.

The FIGS. 8-9 show another embodiment of the present invention, whose structure is similar to the structure of the embodiment shown in FIGS. 1-7. The difference is that the skating device 10' comprises an ice blade 9 instead of the wheel. The ice blade 9 is secured directly to the wheel-rack 5 of the mounting bracket 1' so as to be located at two sides of the shoe body, and no auxiliary support 51 is needed. The other structures of the mounting bracket 1' are same as those of the mounting bracket 1.

Corresponding to the values of the angles A and B as mentioned before, the ratio of the distance between the foremost end where the ice blade 9 contacts the ground and the foremost end of the sole to the distance between the sole and the ground is more than 1.5:1, preferably 1.7:1 to 10:1; the ratio of the distance between the aftermost end where the ice blade 9 contacts the ground and the aftermost end of the sole to the distance between the sole and the ground is more than 1.5:1, preferably 1.7:1 to 10:1.

In a preferable case, the distance between the foremost end where the ice blade 9 contacts the ground and the foremost end of the sole is more than 30% of the length of the sole; the distance between the aftermost end where the ice blade 9 contacts the ground and the aftermost end of the sole is located is more than 25% of the length of the sole.

In order to enhance the antiskid effect, the front and rear edges of the blade or the toe and the heel may be provided with an antiskid device having nonskid tooth pattern or other antiskid devices suitable for ice surface.

In other preferable cases of the present invention, the distance between the sole of the skate and the ground is 6-15% of the length of the sole.

With the above said invention, the user may easily control the motion and keep balance of the body through toe or heel during skating, and may not get tumbled easily. Thus, it will be soon for the beginner to possess the skills of skating.

What is claimed is:

1. A skate including a shoe body and a skating device, a sole of the shoe body comprising a front part, a middle bow part and a rear part, characterized in that:

the skating device is mounted only under the middle bow part such that a toe of the front part and a heel of the rear part can respectively contact with the ground to function as a brake; when the toe of the front part contacts with the ground, an angle between a plane of the sole and the ground is less than 45°, and when the heel of the rear part contacts with the ground, the angle between the plane of the sole and the ground is less than 45°; the skating device comprises a mounting bracket connected with the shoe body, at least two rows of wheels front and rear, each row of wheels having at least two wheels left and right under the middle bow part and at two sides of the shoe body, and at least two axles through which the wheels are mounted on the mounting bracket; a shortest distance between the axles and a foremost end of the sole is more than 30% of a length of the sole, and a shortest distance between the axles and an aftermost end of the sole is more than 25% of the length of the sole;

wherein a length of the front part measured in a longitudinal direction of the sole is not less than 30% of a length of the sole, and a length of the rear part measured in the longitudinal direction of the sole is not less than 20% of the length of the sole.

2. The skate as set forth in claim 1, characterized in that: the angle formed by the toe contacting the ground is 10°-35°.

3. The skate as set forth in claim 1, characterized in that: the angle formed by the heel contacting the ground is 10°-35°.

4. The skate as set forth in claim 1, characterized in that: the distance between the sole and the ground is 6% to 15% of the length of the sole.

5. The skate as set forth in claim 1, characterized in that: the mounting bracket comprises a footplate contacting the sole directly, a wheel-rack connected with the footplate, and an auxiliary support connected to a side face of the wheel-rack for mounting the axles.

6. The skate as set forth in claim 5, characterized in that: conjoining holes are formed on side faces of the auxiliary support and the wheel-rack correspondingly, through which conjoining holes a bolt secures the auxiliary support to the side face of the wheel-rack.

7. The skate as set forth in claim 6, characterized in that: said axles are comprised of a bolt and a cap, the cap comprising an axle portion formed with internal thread hole and a cap portion having larger diameter than the axle portion, the axle portion engaging with an axle bolt so as to form the axles of the wheels, the cap portion stopping the wheel so as to position the wheels.

8. The skate as set forth in claim 1, characterized in that: the skating device is further provided with a vibration absorbing element.

9. The skate as set forth in claim 1, wherein the mounting bracket has a footplate for contacting and receiving the sole of the shoe body and a band coupled to the footplate, and the skating device is detachably attached to the shoe body with the band.

* * * * *